US009984670B2

(12) United States Patent
Zintel et al.

(10) Patent No.: US 9,984,670 B2
(45) Date of Patent: May 29, 2018

(54) METHOD OF INFLUENCING THE EXHAUST NOISE OF A MOTOR VEHICLE AND EXHAUST SYSTEM FOR A MOTOR VEHICLE

(71) Applicant: Faurecia Emissions Control Technologies, Germany GmbH, Augsburg (DE)

(72) Inventors: Gerhard Zintel, Nuremberg (DE); Martin Unbehaun, Nuremberg (DE); Dennis Boennen, Augsburg (DE); Tobias Schindele, Poettmes (DE)

(73) Assignee: Faurecia Emissions Control Technologies, Germany GmbH, Augsburg (DE)

( * ) Notice: Subject to any disclaimer, the term of this patent is extended or adjusted under 35 U.S.C. 154(b) by 0 days. days.

(21) Appl. No.: 14/677,127

(22) Filed: Apr. 2, 2015

(65) Prior Publication Data

US 2015/0287399 A1 Oct. 8, 2015

(30) Foreign Application Priority Data

Apr. 4, 2014 (DE) ..... 10 2014 104 850

(51) Int. Cl.
*G10H 5/10* (2006.01)
*H04R 1/02* (2006.01)
(Continued)

(52) U.S. Cl.
CPC ..... *G10H 5/10* (2013.01); *F01N 1/065* (2013.01); *G10K 11/002* (2013.01); *G10K 11/22* (2013.01); *H04R 1/02* (2013.01); *H04R 2499/13* (2013.01)

(58) Field of Classification Search
CPC ..... G10H 5/10; F01N 1/065; G10K 11/002; G10K 11/22; H04R 1/02; H04R 2499/13
(Continued)

(56) References Cited

U.S. PATENT DOCUMENTS 5,692,052 A * 11/1997 Tanaka ..... F01N 1/065 381/71.11
2007/0071250 A1 3/2007 Garabedian
2013/0142352 A1 6/2013 Koch et al.

FOREIGN PATENT DOCUMENTS

DE 197 46 523 B4 6/2006
EP 0470656 A1 2/1992

OTHER PUBLICATIONS

International Search Report from corresponding PCT application, dated Jun. 26, 2015.
English translation of IPRP dated Oct. 4, 2016.

* cited by examiner

*Primary Examiner* — David Ton
*Assistant Examiner* — Douglas Suthers
(74) *Attorney, Agent, or Firm* — Carlson, Gaskey & Olds, P.C.

(57) ABSTRACT

In a method of influencing the exhaust noise of a motor vehicle, a control unit generates noise package signals, the control unit transmits the noise package signals individually or so as to superimpose a basic signal to a loudspeaker associated with an exhaust branch of the motor vehicle, and the loudspeaker converts the individual noise package signals or the basic signal superimposed with the noise package signals into sound waves, with individual noise package signals being emitted by the loudspeaker as time-limited sound wave packages, so-called noise packages. Furthermore, an exhaust system is shown.

22 Claims, 2 Drawing Sheets

(51) Int. Cl.

| | |
|---|---|
| ***F01N 1/06*** | (2006.01) |
| ***G10K 11/00*** | (2006.01) |
| ***G10K 11/22*** | (2006.01) |

(58) Field of Classification Search
USPC ..... 381/61, 71.1, 71.2, 71.5, 71.9, 71.14, 86
See application file for complete search history.

METHOD OF INFLUENCING THE EXHAUST NOISE OF A MOTOR VEHICLE AND EXHAUST SYSTEM FOR A MOTOR VEHICLE

RELATED APPLICATION

This application claims priority to German Application No. 10 2014 104 850.4, filed 4 Apr. 2014.

TECHNICAL FIELD

The present invention relates to a method of influencing the exhaust noise of a motor vehicle and to an exhaust system for a motor vehicle.

BACKGROUND

The acoustic impression of a motor vehicle is determined for the most part by the exhaust noise, that is, the sound waves emerging from the outlet of the exhaust system. In modern motor vehicles, in particular those having diesel engines, the noises and oscillations that are originally generated by the engine and are directed into the exhaust system are greatly affected and damped by exhaust gas purification systems such as catalytic converters or particulate filters. The exhaust noise therefore no longer corresponds to the natural, undamped engine noise; rather, it sounds damped and not very sporty. Also in the case of smaller engines such as four-cylinder engines, the exhaust noise sounds little attractive.

To provide a remedy and to give such vehicles a sportier sound, exhaust systems are known in which a loudspeaker is in fluid communication with the exhaust branch, so that it can emit sound waves into the exhaust branch. This allows the exhaust noise to be influenced by a selective control of the loudspeaker.

Usually, an attempt is made to generate an exhaust noise that consists of two components.

The first component of the exhaust noise consists of harmonic oscillations generated by the engine. The fundamental order of the harmonic oscillations has the frequency of half the rotational frequency of the engine and the higher orders are multiples thereof. Accordingly, the frequency of these harmonic oscillations is dependent on the speed of the engine.

In FIG. 1, the frequencies of three orders are schematically plotted at different speeds for an exemplary 4-cylinder engine. Only these three orders are present at the end of a common exhaust system, that is, at the outlet of the tailpipe into the environment. They are shown as solid lines in FIG. 1. The sound of these three harmonic oscillations is unnatural and not very sporty.

For this reason, it is known to insert harmonic oscillations that correspond to further orders, in particular intermediate orders, into the exhaust branch through the loudspeaker. They are illustrated as dashed lines in FIG. 1. An exhaust noise generated in this way sounds considerably more attractive and more high-quality.

The second component of the exhaust noise is the so-called static noise. Static noise results from the steady component of the flow velocity of the exhaust gas. High flow velocities cause swirls in the exhaust branch, which, in turn, are perceived as noise. The steady component of the flow velocity increases as the quantity of exhaust gas produced by the engine—hence, the engine speed—increases, and will be perceivable as of a particular speed. The static noise can also be generated or increased by the loudspeaker so as to obtain as natural an acoustic pattern as possible.

However, particularly at low engine speeds, even an exhaust noise influenced in this way does not yet correspond to the natural exhaust noise of the engine used or that of a more sporty engine the sound of which one tries to simulate.

It is the object of the invention to provide a method of influencing the exhaust noise of a motor vehicle and also an exhaust system for a motor vehicle which further enhances the impression of a natural and/or sporty exhaust noise.

SUMMARY

The object is achieved by a method of influencing the exhaust noise of a motor vehicle, in which (a) a control unit generates noise package signals, (b) the control unit transmits the noise package signals individually or so as to superimpose a basic signal to a loudspeaker associated with an exhaust branch of the motor vehicle, and (c) the loudspeaker converts the individual noise package signals or the basic signal superimposed with the noise package signals into sound waves, wherein individual noise package signals are emitted by the loudspeaker as time-limited sound wave packages, so-called noise packages.

The invention makes use of the fact that, in addition to the two components already described above, the natural exhaust noise of a vehicle has a third component. The third component, which is also referred to as dynamic noise, is caused by momentary peaks in the flow velocity.

For illustrative purposes, FIG. 2 depicts, in a greatly simplified manner, the progression in time of the flow velocity as the sum of steady flow velocity and particle velocity for an imaginary order as a function of the engine speed. It can be seen that, particularly in the case of low speeds, the amplitude of the flow velocity oscillates very greatly. This great oscillation is caused by the greatly oscillating particle velocity which dominates the flow velocity in the low speed range.

However, as the speed increases and thus the frequency of the orders increases, the amplitude of the particle velocity decreases. But the mean flow velocity greatly increases, so that the entire flow velocity increases.

As already described above, a perceivable noise is produced by swirls in the exhaust branch at high flow velocities. The horizontal, dashed line has been drawn in as a fictitious threshold of human perception of noise. In actual fact, however, this threshold is fluid.

As is apparent, the flow velocity repeatedly temporarily exceeds the threshold of perception at low speeds because of the high amplitude of the acoustic particle velocity. A noise is perceptible for a short time in these momentary peaks, which are above the threshold of perception. This noise is limited in time and appears with a periodicity, i.e. a time interval between the appearance of the perceptible noise, which is synchronous with the frequency of the harmonic oscillation. In this context, synchronous means that the periodicity with which the noise momentarily occurs varies with the frequency of the harmonic oscillation, in particular increases when the speed increases.

At higher speeds, the flow velocity is permanently above the threshold of perception, so that the above-described static noise is dominant.

The invention now adds noise packages to the exhaust noise, as a result of which the natural impression of the exhaust noise is greatly enhanced since the noise packages are perceived as a time-limited noise, which corresponds to the dynamic noise.

By way of illustration, the noise generated by the noise packages can be thought of as the air noises of a manual air pump that is operated very rapidly and which does not generate sounds. Noise packages do also not generate any audible sounds or overtones, nor are they perceived as such.

The time dependence of the amplitude function of the noise packages can be understood as an amplitude modulation of a noise signal having an originally constant mean amplitude with the basic signal.

Both signals are then superimposed by simple addition, whereby the method is kept as simple as possible.

The control unit may be the engine control itself or may be coupled to it.

Preferably, the noise package signals, in particular at least one of their periodicity, their length in time, the shape of their envelopes, the amplitude of their envelopes and their frequency spectrum, are selected as a function of the current operating condition of the vehicle, in particular at least one of the engine load, the engine speed and the temperature of the gas in the exhaust branch. In this way, it can be made sure that the noise package signals generated and thus the noise packages generated are selected such that they reproduce as natural a sound as possible and harmoniously complement with the actual noises that originate from the engine.

Here, the engine control can transmit information about the operating condition of the vehicle to the control unit, in particular about the engine load, the engine speed, and/or the temperature of the exhaust branch.

As an alternative, the control unit may be integrated in the engine control.

For example, the periodicity of the noise package signals is equal to or greater than 5 Hz; more particularly, it is in the range of from 5 Hz to 500 Hz, as a result of which noise packages can be generated for harmonic oscillations of the frequencies of from 5 Hz to 500 Hz.

The frequency spectrum of the noise package signals may contain frequencies between 100 Hz and 4000 Hz here.

In a variant embodiment, synthetically generated noise, in particular colored noise, or sections of recorded noise stored in the control unit and of stored, recorded noise packages are used for generating the noise package signals. This allows the sound of the noise packages to be changed as desired and to be adjusted to the natural dynamic noise.

It is also conceivable that the noise package signals are also generated from superimpositions of a plurality of recorded noise packages.

Preferably, at least seven successive noise package signals constitute a noise package pattern, the duration of the noise package pattern being longer than 1 second, preferably longer than 20 seconds when the noise package pattern repeats itself, in order to avoid that tonal oscillations are produced by the addition of the noise packages.

Tonal oscillations develop when individual noise package signals are regularly repeated with a repetition frequency which is in the audible range of the human ear. These tonal oscillations may then be perceived as artificial or disturbing. Owing to the predefined, relatively long minimum duration of the noise package pattern, it can be prevented that individual noise packages are repeated regularly with a disturbing repetition frequency.

These problems of tonal oscillations, however, only appear when recorded noise is used for generating the noise package signals, rather than random noise newly generated for each of the noise package signals.

In this connection, two respective successive noise package signals and more particularly all noise package signals may exhibit different frequency spectra.

For example, the control unit generates the basic signal, in particular synthetically, the basic signal featuring a superposition of harmonic oscillations which correspond to half the rotational frequency of the engine and higher orders thereof. In this way, all harmonic oscillations can be simulated which were originally generated by the engine.

Particularly in the case of high engine speeds, the basic signal may feature continuous noise here, in order to have the loudspeaker generate static noise.

In one configuration of the invention, the noise package signals are generated as a function of the basic signal, in particular on the basis of one or more selected harmonic oscillations of the basic signal, in particular by amplitude modulation of the noise with the amplitude of the basic signal or with the amplitude of one or more selected harmonic oscillations of the basic signal. This allows the noise package signals to be generated to match the basic signal.

In a variant embodiment, the noise package signals are also or exclusively generated on the basis of low-frequency harmonic oscillations which cannot be effectively generated by the loudspeaker, which creates the impression that these harmonic oscillations are existent in the exhaust noise. The loudspeakers that are commonly used in automobile manufacturing cannot effectively represent frequencies below 50 Hz for a system for influencing the exhaust noise. As a result, even in the case of low engine speeds, engine orders that generate harmonic oscillations with frequencies below this threshold cannot be emitted in a useful manner into the exhaust branch. It has been found, however, that the impression of these low orders can be generated in that noise packages with the periodicity of that frequency of the harmonic oscillation that cannot be effectively generated are emitted by the loudspeaker. In this way, the impression is created that these low-frequency oscillations are in fact present in the exhaust noise. The absence of the actual low-frequency oscillation will not be particularly noticed since higher frequencies are perceived better by the human ear.

The control unit may transmit noise package signals to the loudspeaker individually if the noise package signals were generated on the basis of low-frequency harmonic oscillations which cannot be effectively generated by the loudspeaker. As a result, the loudspeaker exclusively emits noise packages and in this way creates the impression of low-frequency harmonic oscillations.

Also in the generation of noise package signals which suggest low-frequency harmonic oscillations which cannot be effectively generated, at first a basic signal can be generated on the basis of which the noise package signals are generated.

After formation of the noise package signals, the frequency spectrum of the basic signal is reduced to the frequencies which the loudspeaker can effectively represent. Therefore, in the case in which the noise package signals were generated relating to harmonic oscillations which cannot be effectively generated, nothing will remain of the basic signal.

In one embodiment of the invention, the periodicity of the noise package signals is synchronous with the frequency of the lowest harmonic oscillation on the basis of which the noise package signals are generated, so that the impression is created that the lowest-frequency harmonic oscillation is existent in the exhaust noise.

In one configuration of the invention, the amplitudes of the envelopes of the noise package signals are selected as a function of the amplitude of the harmonic oscillations to which the periodicity of the noise package signals was adjusted. This also allows the loudness of the noise package to be adjusted to the real or simulated loudness of the associated harmonic oscillation.

In one variant embodiment, the noise package signals are superimposed on the basic signal so as to be offset in relation to that point in time of the basic signal that corresponds to the maximum displacement of the loudspeaker diaphragm of the loudspeaker. Normally, the full displacement of the loudspeaker diaphragm is already used for generating the harmonic oscillations. Now, if a noise package were to be generated in addition to the harmonic oscillation at the point of time of the maximum displacement, it would thus be necessary either to increase the maximum displacement of the loudspeaker diaphragm or to reduce the power of the harmonic oscillation. In the final analysis, both would involve the use of a more powerful and more expensive loudspeaker. To avoid this, it has been found that the noise package signals can also be generated offset in time because the offset is not perceivable by the human ear.

The object is further achieved by an exhaust system for a motor vehicle, including an exhaust branch, a loudspeaker associated with the exhaust branch, and a control unit controlling the sound emission of the loudspeaker, the control unit being adapted to generate noise package signals and to transmit the noise package signals to the loudspeaker individually or so as to superimpose a basic signal, the loudspeaker emitting sound waves corresponding to the individual noise package signals, so-called noise packages, or the basic signal superimposed with the noise package signals into the exhaust branch. The advantages as mentioned above of the emission of noise packages are equally applicable.

Also, the control unit generates the noise packages, in particular at least one of their periodicity, their length in time, the shape of their envelopes, the amplitude of their envelopes and their frequency spectrum, as a function of the current operating condition of the vehicle, in particular at least one of the engine load, the engine speed and the temperature of the gas in the exhaust branch.

Preferably, the control unit first generates the basic signal and subsequently the noise packages based on one or more selected harmonic oscillations of the basic signal.

For example, the control unit generates noise package signals on the basis of harmonic oscillations which cannot be effectively converted to sound waves by the loudspeaker, so that the loudspeaker merely emits the noise packages of these harmonic oscillations. As already described above, this creates the impression that these harmonic oscillations are existent.

In one configuration of the invention, the loudspeaker is adapted to emit noise packages with a periodicity which correspond to noise package signals, the periodicity being synchronous with the frequency of the lowest harmonic oscillation on the basis of which the control unit has generated the noise package signals.

Preferably, the control unit is adapted to superimpose the noise package signals on the basic signal so as to be offset in relation to that point in time of the basic signal that corresponds to the maximum displacement of the loudspeaker diaphragm of the loudspeaker.

The advantages mentioned in relation to the method correspondingly apply to the exhaust system; any desired further features which have been described only in connection with the method are also applicable to the exhaust system with the respective advantages.

BRIEF DESCRIPTION OF THE DRAWINGS

Further features and advantages of the invention will be apparent from the description below and from the accompanying drawings, to which reference is made and in which.

DETAILED DESCRIPTION

Figure 1:
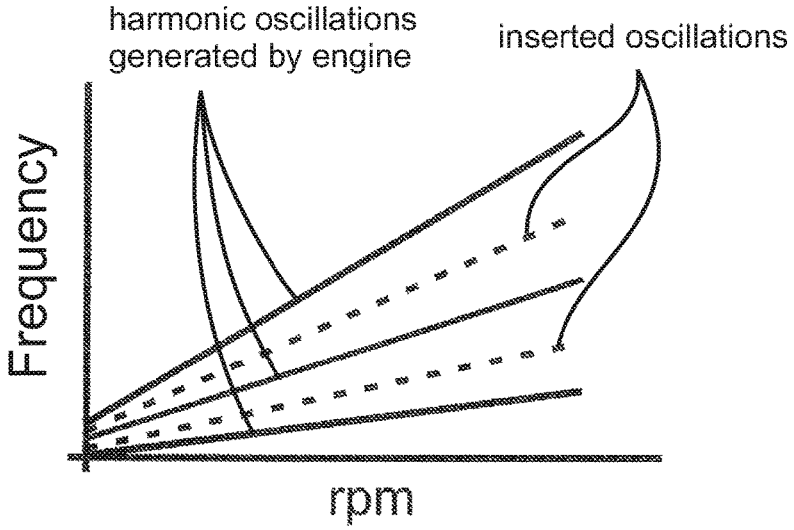
Fig. 1 Prior Art
FIG. 1 shows an illustration of existing frequencies and frequencies that are additionally generated by a known method, as a function of the engine speed.
Figure 2:
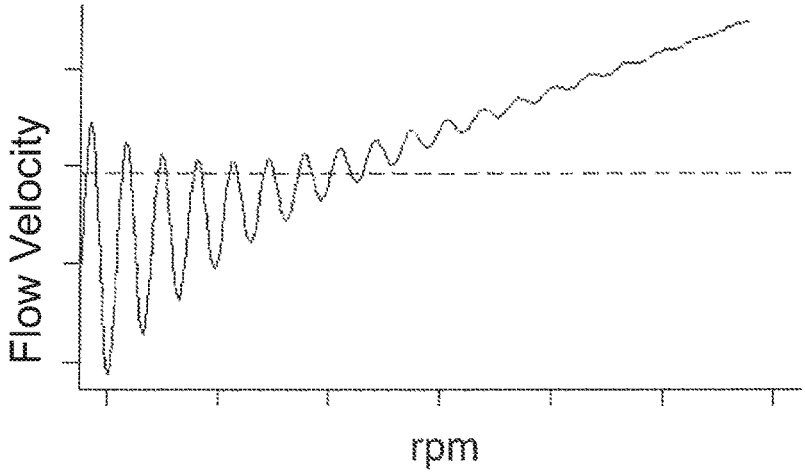
FIG. 2 shows a greatly simplified diagram of the current flow velocity as a function of the engine speed.
Figure 3:
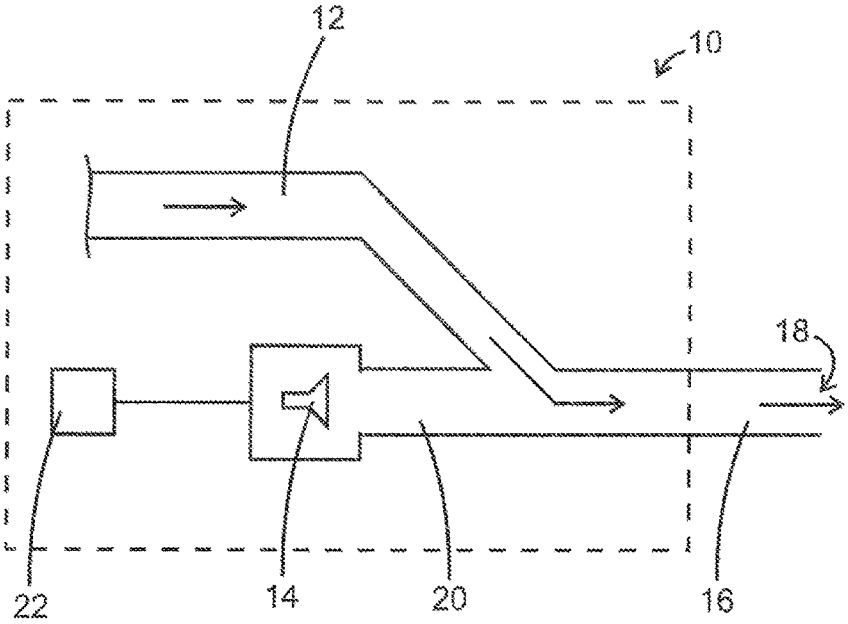
FIG. 3 schematically shows an exhaust system according to the invention.

FIG. 3 schematically illustrates an exhaust system 10 of a vehicle (indicated as a dashed line) which has an exhaust branch 12 and a loudspeaker 14.

The exhaust branch 12 continues into a tailpipe 16 which at an outlet 18 emits exhaust gas to the surroundings of the vehicle.

The loudspeaker 14 is fluidically connected with the exhaust branch 12 via a channel 20 and is thus associated with the exhaust branch 12.

The loudspeaker 14 is operated and controlled by a control unit 22 to which it is electrically connected.

The control unit 22, in turn, may be connected to the engine control (not shown) or may form a part thereof.

The control unit 22 is adapted to generate noise package signals and/or a basic signal for transmission to the loudspeaker 14. The loudspeaker 14, for its part, can convert the signals it receives from the control unit 22 to sound waves.

The flow of the exhaust gas runs from the engine (not shown) through the exhaust branch 12 to the tailpipe 16 and via the outlet 18 to the environment. The direction of flow is indicated by arrows.

Figure 4:
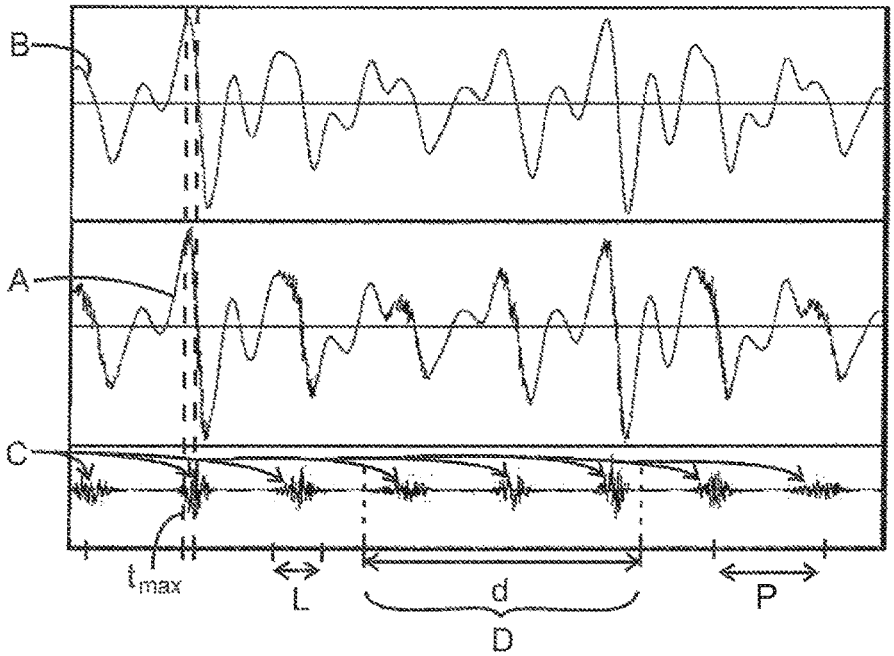
FIG. 4 shows an illustration of the sound pressure level, and of the components thereof, which is generated by the loudspeaker of the exhaust system according to FIG. 3 when carrying out the method according to the invention.

FIG. 4 illustrates the sound pressure level generated by the loudspeaker 14, and its components. The sound pressure level generated by the loudspeaker 14 is directly proportional to the signal generated by the control unit 22 and applied to the loudspeaker 14, so that FIG. 4 is also made use of for illustrating this signal. For the sake of simplicity, reference will be made in the following only to the signals and not to the sound pressure level.

The graph in the middle, denoted by A, shows the total signal transmitted to the loudspeaker 14 by the control unit 22. The signal is composed of two components, more specifically the basic signal B (top) and the noise package signals C, the chronological sequence of which is illustrated in the lowermost signal of FIG. 4.

The signal A can now be generated by superposition of the basic signal B with the noise package signals C. Generation of the signal A by the control unit 22 is done as follows.

First, the control unit 22 generates the basic signal B. More particularly, generation may be synthetic here.

The basic signal B features a superposition of harmonic oscillations which correspond to half the rotational frequency of the engine, the fundamental order and higher orders thereof.

Furthermore, especially in the case of high engine speeds, the basic signal B may feature continuous noise, which corresponds to the static noise of a natural engine signal.

Further, the noise package signals C are generated by amplitude modulation of a noise having a constant mean amplitude with the amplitude of the basic signal B by the control unit 22. The total basic signal B or single harmonic oscillations of the basic signal B may be used for this purpose.

In doing so, only the exclusively positive portions of the amplitude of the basic signal B are made use of for modulation of the amplitude of the noise, and no noise signal C is generated while the basic signal B is negative.

As an alternative, the basic signal B can be rectified prior to the amplitude modulation, and then the whole signal can be used for modulation of the amplitude of the noise.

The noise package signals C here are individual time-limited wave packages which are generated with a periodicity P, that is, a specific time interval.

The periodicity P of the noise package signals C is equal to or greater than 5 Hz and, more particularly, is in the range of from 5 Hz to 500 Hz.

The frequencies of the wave packages, that is, of the noise package signals C, are between 100 Hz and 4,000 Hz, for example.

For generating a basis for the individual noise package signals C, use is made of synthetically generated noise, in particular colored noise, and/or sections from recorded noise stored in the control unit. The recorded noise may be recorded noise packages and also continuous noise from which short parts are extracted, which then constitute the basis of the noise package signals C.

The noise package signals C may also be generated in that a plurality of recorded noise packages is superposed and in this way forms the basis for the noise package signal C to be generated.

A plurality of, but at least seven, successive noise package signals C can form a noise package pattern D.

Such a noise package pattern D preferably does not repeat itself.

But where a repetition of the noise package pattern D cannot be avoided, the duration d of the noise package pattern D is at least 1 second, preferably at least 5 seconds, particularly preferably at least 20 seconds. Here, the duration d of the noise package pattern D is the time interval between the start of the first noise package signal C and the end of the last noise package signal C of the noise package pattern D.

A repetition is understood to mean, for example, a case when the noise package pattern D starts again within 10 seconds from its end. In this way, tonal oscillations can be effectively prevented from developing since noise package signals C are only regularly repeated at a very low repetition frequency, if at all.

After generating the basis of the noise package signals C, the periodicity P, their length in time L, the shape of their envelopes, the amplitude of their envelopes and/or their frequency spectrum can be adjusted by the control unit 22. The adjustment can be selected here as a function of the operating condition of the vehicle, in particular the engine load, the engine speed and/or the temperature of the exhaust branch.

It is possible here for the control unit 22 to obtain information from the engine control about the operating condition of the vehicle, in particular the engine load, the engine speed and/or the temperature of the exhaust branch.

The adjustment of the noise package signals C, in particular their periodicity P, their length in time L, the shape of their envelopes, the amplitude of their envelopes and/or their frequency spectrum can also be effected by the control unit 22 as a function of one or more harmonic oscillations of the basic signal B.

The amplitudes of the envelopes of the noise package signals C may be selected here as a function of the amplitude of the harmonic oscillations on the basis of which the noise package signals C are generated.

Particularly the periodicity P results from the selected harmonic oscillations of the basic signal B, the periodicity P being synchronous with the frequency of the lowest harmonic oscillation on the basis of which the noise package signals C were generated.

Following the generation of the noise package signals C, the frequency spectrum of the basic signal B can be reduced to those frequencies which are effectively generatable by the loudspeaker 14. As a rule, loudspeakers for exhaust systems cannot effectively generate frequencies below 50 Hz.

The shape of the noise package signals C is generated by amplitude modulation with the basic signal B and is then superimposed thereon by simple addition.

Here the superimposition of the noise package signals C with the basic signal B may occur so as to be offset such that the noise package signals C are not superimposed on the basic signal B at that point in time $t_{max}$ of the basic signal B which corresponds to the maximum displacement of the loudspeaker diaphragm of the loudspeaker 14. This offset in time can also be seen in FIG. 4, but it is not perceived by the human ear.

For example, the noise package signal C is offset in time relative to the basic signal such that the maxima of the amplitudes of the noise packages will be in the proximity of the zero crossings of the basic signal B.

After the superimposition of the basic signal B with the noise package signals C, the control unit 22 transmits the signal A to the loudspeaker 14. The loudspeaker 14 emits sound waves corresponding to the signal A, that is, corresponding to the basic signal B having the noise package signals C superimposed thereon, into the exhaust branch 12.

In signal generation and transmission to the loudspeaker 14, the control unit 22 can also take the transit time into account which the sound waves require for travelling through the channel 20, in order to avoid any undesirable interferences with the sound waves originating from the engine.

In the event that the entire basic signal B is comprised of frequencies that are so low that they cannot be effectively generated by the loudspeaker 14, in particular of frequencies below 50 Hz, the noise package signals C are transmitted by the control unit 22 to the loudspeaker 14 individually, that is, without a basic signal B. In that case the loudspeaker 14 merely generates noise packages which correspond to the noise package signals C.

This case occurs in particular at low engine speeds since the frequencies of the low-order harmonic oscillations of the engine are frequently below 50 Hz at low engine speeds, i.e. the noise package signals C are generated based on harmonic oscillations which cannot be effectively generated by the loudspeaker 14.

It is also conceivable that the channel 20 also opens into the surroundings of the vehicle in the region of the outlet 18 of the exhaust branch 12, rather than into the exhaust branch 12 itself. In such an arrangement, too, the sound waves generated by the engine and directed through the exhaust branch 12 are superimposed with those that were generated by the loudspeaker 14, so that the loudspeaker 14 is associated with the exhaust branch 12.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A method of influencing the exhaust noise of a motor vehicle, in which (a) a control unit generates colored noise package signals, (b) the control unit transmits the colored noise package signals individually or so as to superimpose a basic signal to a loudspeaker associated with an exhaust branch of the motor vehicle, and (c) the loudspeaker converts the individual colored noise package signals or the basic signal superimposed with the colored noise package signals into sound waves, wherein each of the colored noise package signals is emitted by the loudspeaker as a time-limited sound wave package that corresponds to dynamic noise, wherein the control unit generates the basic signal, the basic signal featuring a superposition of harmonic oscillations which correspond to half the rotational frequency of an engine and higher orders thereof, and wherein amplitudes of envelopes of the colored noise package signals are selected as a function of the amplitude of the basic signal.

2. The method according to claim 1, wherein the colored noise package signals, in particular at least one of their periodicity, their length in time, the shape of their envelopes, the amplitudes of envelopes and their frequency spectrum, are selected as a function of the current operating condition of the vehicle, in particular at least one of the engine load, the engine speed and the temperature of gas in the exhaust branch.

3. The method according to claim 2, wherein the periodicity of the colored noise package signals is equal to or greater than 5 Hz.

4. The method according to claim 3, wherein the periodicity of the colored noise package signals is in the range of from 5 Hz to 500 Hz.

5. The method according to claim 1, wherein synthetically generated noise, or sections of recorded noise stored in the control unit and recorded noise packages stored in the control unit are used for generating the colored noise package signals.

6. The method according to claim 1, wherein at least seven successive colored noise package signals constitute a noise package pattern, wherein the duration of the noise package pattern is longer than at least one second, and wherein the noise package pattern repeats itself.

7. The method according to claim 6, wherein the duration of the noise package pattern is longer than 20 seconds.

8. The method according to claim 1, wherein the control unit generates the basic signal synthetically.

9. The method according to claim 8, wherein the periodicity of the colored noise package signals is synchronous with the frequency of the lowest-frequency harmonic oscillation on the basis of which the colored noise package signals are generated.

10. The method according to claim 9, wherein the amplitudes of envelopes of the colored noise package signals are selected as a function of the amplitude of the harmonic oscillations to which the periodicity of the colored noise package signals is synchronous to.

11. The method according to claim 1, wherein the colored noise package signals are generated as a function of the basic signal, in particular on the basis of one or more selected harmonic oscillations of the basic signal, in particular by amplitude modulation of the noise with the amplitude of the basic signal or with the amplitude of one or more selected harmonic oscillations of the basic signal.

12. The method according to claim 1, wherein the colored noise package signals are also generated on the basis of low-frequency harmonic oscillations which cannot be effectively generated by the loudspeaker.

13. The method according to claim 12, wherein the control unit transmits colored noise package signals to the loudspeaker individually if the colored noise package signals were generated on the basis of low-frequency harmonic oscillations which cannot be effectively generated by the loudspeaker.

14. The method according to claim 1, wherein the colored noise package signals are superimposed on the basic signal to be offset in relation to that point in time of the basic signal that corresponds to the maximum displacement of the loudspeaker diaphragm of the loudspeaker.

15. The method according to claim 1, wherein the colored noise package signals have a constant mean amplitude.

16. An exhaust system for a motor vehicle, comprising:

an exhaust branch having exhaust noise that includes at least three components comprising harmonic oscillations as a first component, static noise as a second component, and as a third component dynamic noise caused by momentary peaks in flow velocity of exhaust gas in the exhaust branch of the motor vehicle;

a loudspeaker associated with the exhaust branch; and a control unit controlling sound emission of the loudspeaker, the control unit being adapted to generate colored noise package signals and to transmit the colored noise package signals to the loudspeaker individually or so as to superimpose a basic signal, the loudspeaker emitting sound waves corresponding to the individual colored noise package signals or the basic signal superimposed with the colored noise package signals into the exhaust branch, wherein each of the colored noise package signals is emitted by the loudspeaker as a time-limited sound wave package, which creates another dynamic noise that is in addition to the dynamic noise caused by momentary peaks, wherein the control unit generates the basic signal, the basic signal featuring a superposition of harmonic oscillations which correspond to half the rotational frequency of an engine and higher orders thereof, and wherein amplitudes of envelopes of the colored noise package signals are selected as a function of the amplitude of the basic signal.

17. The exhaust system according to claim 16, wherein the control unit is adapted to generate the colored noise package signals, in particular at least one of their periodicity, their length in time, the shape of their envelopes, the amplitude of their envelopes and their frequency spectrum, as a function of the current operating condition of the vehicle, in particular at least one of the engine load, the engine speed and the temperature of the gas in the exhaust branch.

18. The exhaust system according to claim 16, wherein the control unit is adapted to generate the basic signal and further generate the colored noise packages based on one or more selected harmonic oscillations of the basic signal.

19. The exhaust system according to claim 16, wherein the control unit is adapted to generate the colored noise package signals on the basis of low-frequency harmonic oscillations which cannot be effectively converted to sound waves by the loudspeaker, so that the loudspeaker merely emits the colored noise packages of these harmonic oscillations.

20. The exhaust system according to claim 16, wherein the loudspeaker is adapted to emit noise packages with a periodicity which correspond to colored noise package signals, the periodicity being synchronous with the frequency of the lowest harmonic oscillation on the basis of which the control unit has generated the colored noise package signals.

21. The exhaust system according to claim 16, wherein the control unit is adapted to superimpose the colored noise package signals on the basic signal to be offset in relation to that point in time of the basic signal that corresponds to the maximum displacement of the loudspeaker diaphragm of the loudspeaker.

22. A method of influencing the exhaust noise of a motor vehicle having at least three components comprising harmonic oscillations as a first component, static noise as a second component, and as a third component dynamic noise caused by momentary peaks in flow velocity of exhaust gas in an exhaust branch of the motor vehicle, in which (a) a control unit generates colored noise package signals, (b) the control unit transmits the colored noise package signals individually or so as to superimpose a basic signal to a loudspeaker associated with the exhaust branch of the motor vehicle, and (c) the loudspeaker converts the individual colored noise package signals or the basic signal superimposed with the colored noise package signals into sound waves, wherein each of the colored noise package signals is emitted by the loudspeaker as a time-limited sound wave package creating another dynamic noise that is in addition to the dynamic noise caused by momentary peaks, wherein the control unit generates the basic signal, the basic signal featuring a superposition of harmonic oscillations which correspond to half the rotational frequency of an engine and higher orders thereof, and wherein amplitudes of envelopes of the colored noise package signals are selected as a function of the amplitude of the basic signal.

* * * * *